US005940465A

United States Patent [19]

Brunelle

[11] Patent Number: 5,940,465

[45] Date of Patent: Aug. 17, 1999

[54] METHOD FOR COUNTING PARTS IN A TRAY

[75] Inventor: Steven J. Brunelle, Boise, Id.

[73] Assignee: Micron Electronics, Inc., Nampa, Id.

[21] Appl. No.: 08/958,553

[22] Filed: Oct. 29, 1997

[51] Int. Cl.[6] ..... G06M 7/00

[52] U.S. Cl. ..... 377/6; 377/8; 377/10

[58] Field of Search ..... 377/6, 8, 10

[56] References Cited

U.S. PATENT DOCUMENTS 4,384,195 5/1983 Nosler ..... 377/53

5,253,538 10/1993 Swick et al. ..... 73/864.34

*Primary Examiner*—Margaret R. Wambach

*Attorney, Agent, or Firm*—Arnold, White & Durkee

[57] ABSTRACT

One embodiment of the invention is an automated method for counting parts. The method includes positioning a tray having an array of part locations; aligning a complementary array of holes in a plate with the part locations; activating air flow through the holes such that the parts will move to alter the air flow; and determining from the altered air flow the number of parts.

12 Claims, 3 Drawing Sheets

METHOD FOR COUNTING PARTS IN A TRAY

FIELD OF THE INVENTION

The present invention relates generally to a method and apparatus for keeping an inventory of parts, more particularly, to an automated method and apparatus for counting and recording parts in a tray.

BACKGROUND OF THE INVENTION

Taking inventory of a large number of stored objects in a factory, warehouse or retail outlet is a formidable, time-consuming, and therefore expensive task. Current conventional methods of drawer, bin or cabinet storage require laborious hand-counting or prolonged weighing operations for each group of stored objects. Even with recent prior art improvements in computer-controlled one-at-a-time weighings of stored units, inventory-taking remains unsatisfactorily costly in time and equipment. In the case of very small objects, such as electronic and industrial components or jewelry, accurate weighing to provide a meaningful count is essential for an inventory to be of value. Unfortunately, errors escalate when conventional inventory weighing techniques are conducted and, thus, the industry has been forced to hand count parts.

Thus, there is a need for a new system for efficient, rapid and accurate inventory control by methods eliminating the process of independent weighings or hand-counts of diverse groups of stored objects. It would also be advantageous to provide such a system that is uncomplicated and could be compatible with a conveyor belt manufacturing process with a minimum cost of installation, operation and maintenance. The present invention is directed to overcoming, or at least reducing, one or more of the problems set forth above.

SUMMARY OF THE INVENTION

One embodiment of the invention is an automated method for counting parts. The method includes positioning a tray having an array of part locations; aligning a complementary array of holes in a plate with the part locations; activating air flow through the holes such that the parts will move to alter the air flow; and determining from the altered air flow the number of parts.

Figure 1:
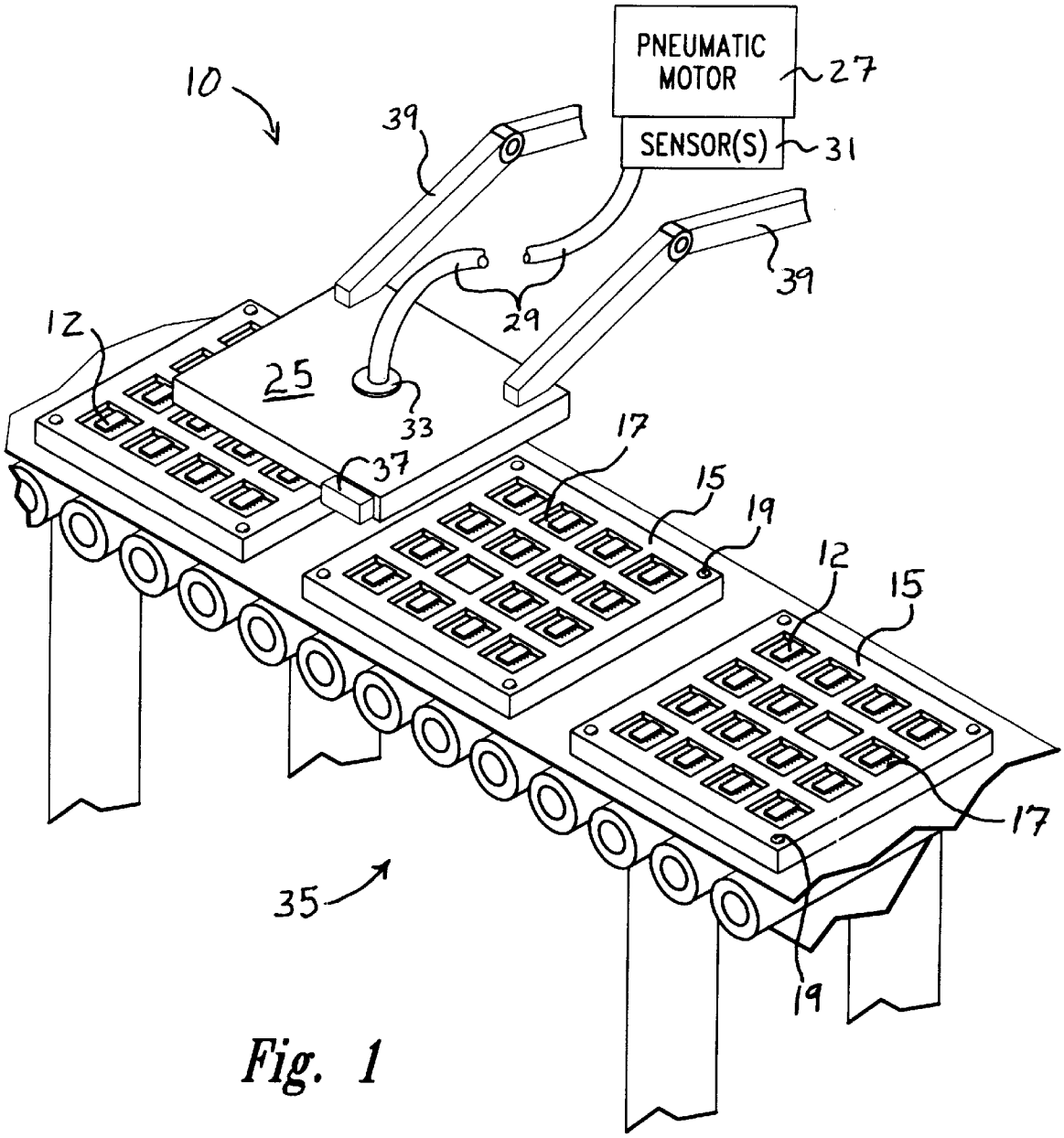
FIG. 1 is a perspective view illustrating a pneumatic system for counting parts in accordance with one embodiment of the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed. On the contrary, the intention is to cover all modifications, equivalents, and alternatives falling within the spirit and scope of the invention as defined by the appended claims.

DETAILED DESCRIPTION OF THE INVENTION

Illustrative embodiments of the invention are described below. In the interest of clarity, not all features of an actual implementation are described in this specification. It will be appreciated that in the development of any actual embodiment, numerous implementation-specific decisions must be made to achieve the developers' specific goals, such as compliance with system-related and business-related constraints, that will vary from one implementation to another. Moreover, it will be appreciated that such a development effort might be complex and time-consuming, but would nevertheless be a routine undertaking for those of ordinary skill in the art having the benefit of this disclosure.

A First Embodiment of the Invention

FIG. 1 is a perspective view of a pneumatic system 10 for counting parts in accordance with one embodiment of the present invention. Parts that may be counted by the pneumatic system 10 can be of any size and weight and are generally regulated by the financial and spatial constraints established by the user for the system 10. For purposes of an example, however, the parts counted in the embodiment illustrated are semiconductor chips 12.

A tray 15 containing the chips 12 provides a rigid structure made from a conventional composite or metallic material. Each part location 17 is an indentation or compartment that in the tray 15 that may contain a chip 12. As depicted in FIG. 1, tray 15 provides an array of locations 17 across the spatial area of the tray 15. The particular embodiment illustrated includes stacking or positioning knobs 19 provided in the outer corners of the tray 15 to allow various trays to be stacked onto one another for storage. Additionally, these positioning knobs 19 assist in aligning a pneumatic plate 25 over the tray for assisting with an effective operation in those embodiments including positioning knobs 19. It will be appreciated by those skilled in the relevant arts having the benefits of this disclosure that the dimensions and structure of the tray 15 and the locations 17 for containing the parts 12 are primarily dictated by the parts 12 to be contained. In other words, if large parts (not shown) can only be counted one at a time, there would be no need for an array of locations 17.

A plate 25 connects to a pneumatic motor 27 through a hose 29 and sensor(s) panel 31. The pneumatic motor 27 comprises any conventional fan-type motor 27 for providing air flow, e.g., suction, from the plate 25, though the hose 29 and into the pneumatic motor 27. The size and power of the motor 27 will depend on the size and weight of the parts with which the pneumatic system 10 will interact and the size of the tray 15 over which the plate 25 will be deployed. The hose 27 can be constructed of a conventional material such as rubber or a pliable composite material, and is coupled to the plate 25 by a conventional technique, such as a seal 33 made of a similar material as the hose 27. The sensor panel 31 includes at least one pressure sensor element.

In an alternative embodiment not shown, a simple table could provide an adequate surface for supporting the trays 15 of the pneumatic system 10. However, with the intent of increasing productivity and decreasing manual labor, the embodiment illustrated in FIG. 1 supports a plurality of trays 15 on a conveyor belt assembly 35. In operation, the conveyor belt 35 moves the trays 15 along the production line to/from one or more specific inspection stations or further development locations. The embodiment of the system 10 illustrate in FIG. 1, because of its small size and simple implementation, can be incorporated at nearly any such pre-established location without requiring any major modification in the manufacturing production line.

It will be appreciated by those skilled in the relevant arts having the benefits of this disclosure that the pneumatic plate 25, motor 27, hose 29, and sensor(s) panel 31 structure could be coupled to an automated structure 39, e.g. robotic arm. On the other hand, if desired, these elements could also be constructed as a portable unit for the user to deploy. In either situation, such a pneumatic system 10 could benefit by incorporating a tray sensor 37 coupled to the plate 25 or to the conveyor belt 35 (not shown) for stopping the belt when an oncoming tray 15 reaches a predetermined location. The tray sensor 37 would assist in quickly aligning the pneumatic plate 25 over the tray 15 of parts 12 to be counted. The sensor(s) panel 31 and tray sensor 37 could be of a reflected light or mechanical marker technology.

Figure 2:
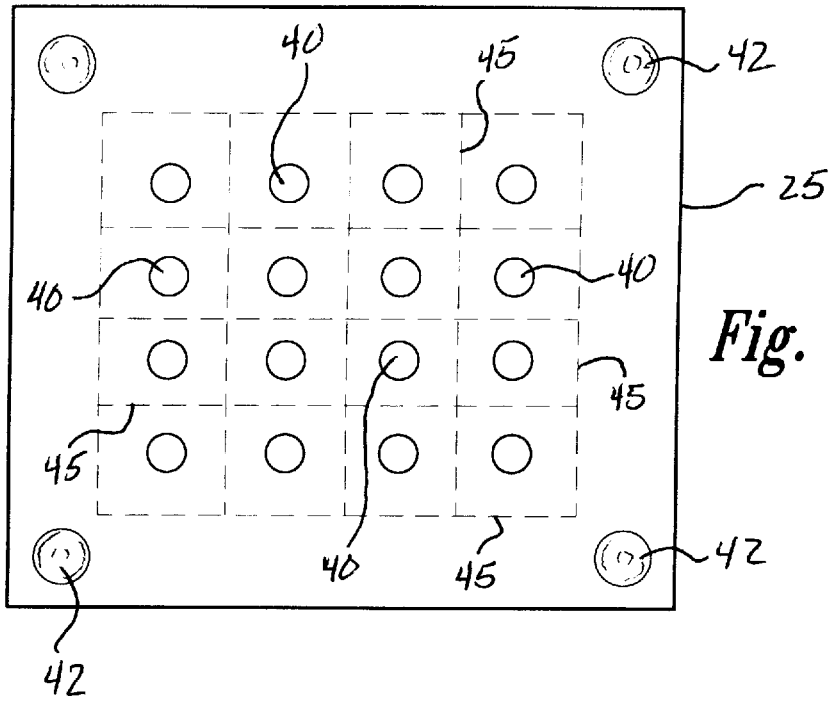
FIG. 2 is a bottom view of the plate for the embodiment of FIG. 1.
Figure 4:
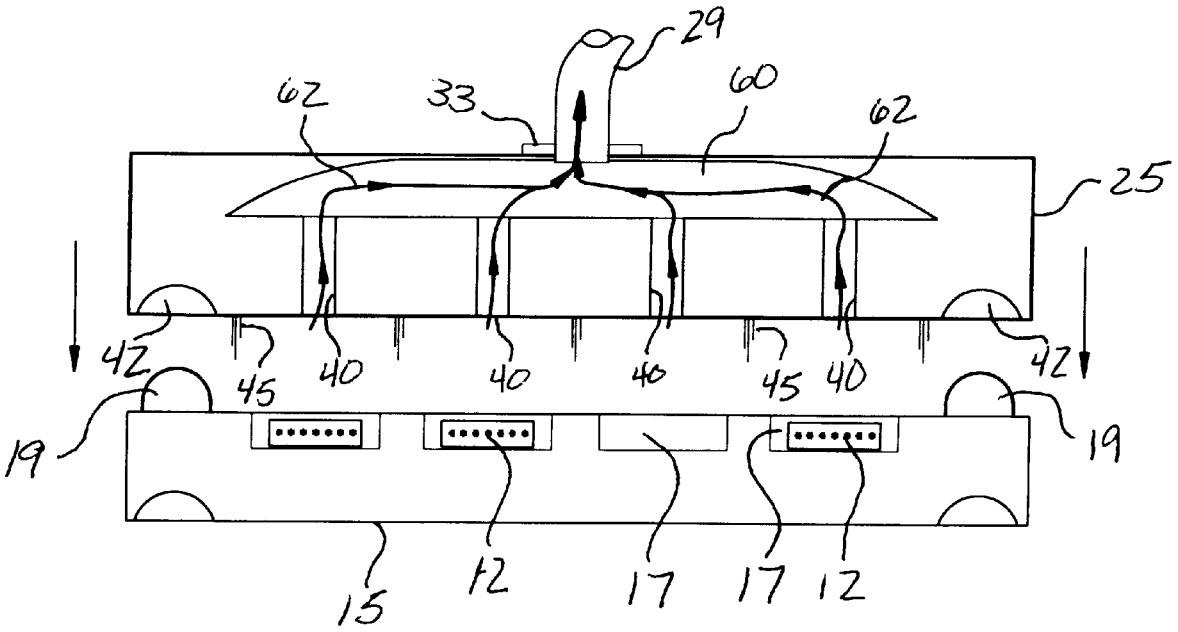
FIG. 4 is a cut-away view of the system in FIG. 1 as employed in accordance with the first and second steps of FIG. 3.

Referring now to FIG. 2, the bottom side 38 of the pneumatic plate 25 is illustrated. More specifically, a plurality of holes 40 extend from the surface of the bottom side to an inner chamber 60 shown in FIGS. 4 and 5 to provide the air flow from the motor 27 to the pneumatic plate 25. The holes 40 are arranged in an array complementing the locations 17 of the tray 15 when the pneumatic plate 25 is positioned over the tray 15.

Additionally, the bottom side 38 of the pneumatic plate 25 in some embodiments also provides complementary positioning indents 42. The indents 42 dimensionally complement the positioning knobs 19 of the tray 15. Consequently, when positioning the plate 25 over the tray 15 by allowing the indents 42 to receive the knobs 19, the holes 40 align directly above respective locations 17 containing a part 12. If desired, dividing walls 45 may be connected to the bottom surface 38 of the pneumatic plate 25 to surround the holes 40 and define a chamber between each respective hole 40 and part location 17. The walls 45 would be made of a pliable material such as rubber or material fibers.

Figure 3:
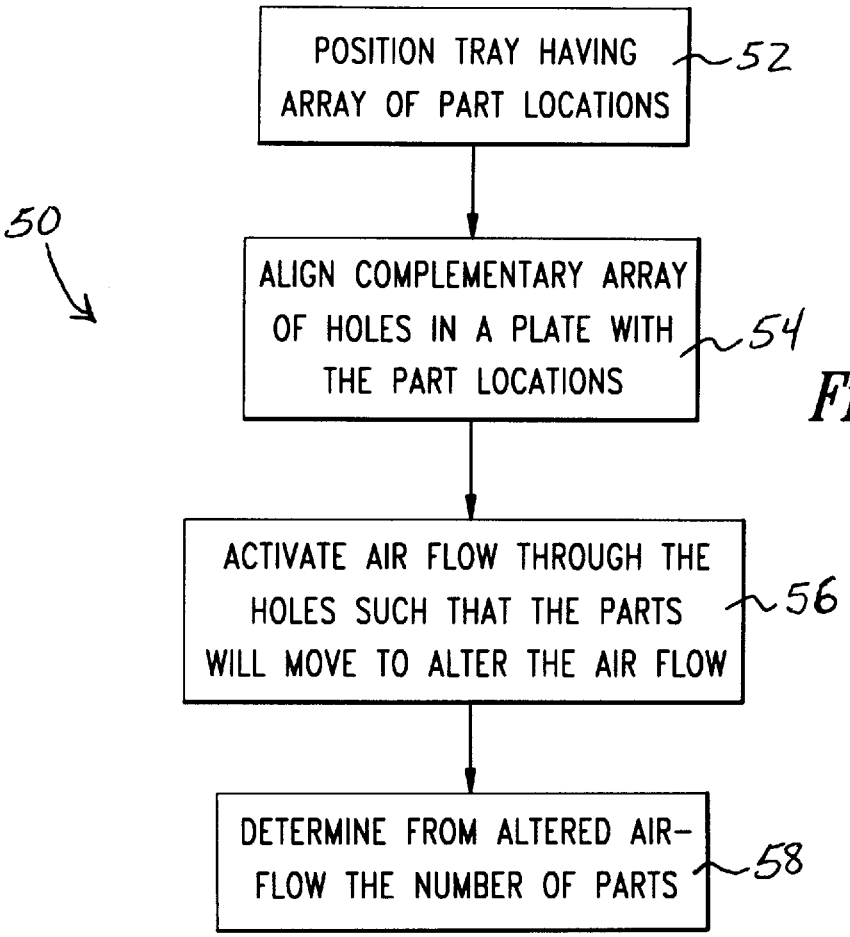
FIG. 3 illustrates one embodiment of a method for counting parts practiced in accordance with the present invention.

FIG. 3 illustrates a method 50 for implementing one embodiment of the pneumatic system 10 as illustrated in FIGS. 1 and 2 in accordance with the present invention. Initially, the system 10 will "position the tray 15 having an array of part locations 17" as set forth in block 52 to a predetermined position on the conveyor belt assembly 35 or a table (not shown). With the tray 15 in the predetermined position, the system 10 will next "align the complementary array of holes 40 in the plate 25 with the part locations 17" of the tray 15 as set forth in block 54. As depicted in the cross-sectional view of FIG. 4, once the plate 25 and tray 15 are aligned with respect to each other, the plate 25 can be lowered over the tray 15 such that the knobs 19 and indents 42 join to align the holes 40 above the part locations 17 of the tray 15.

Figure 5:
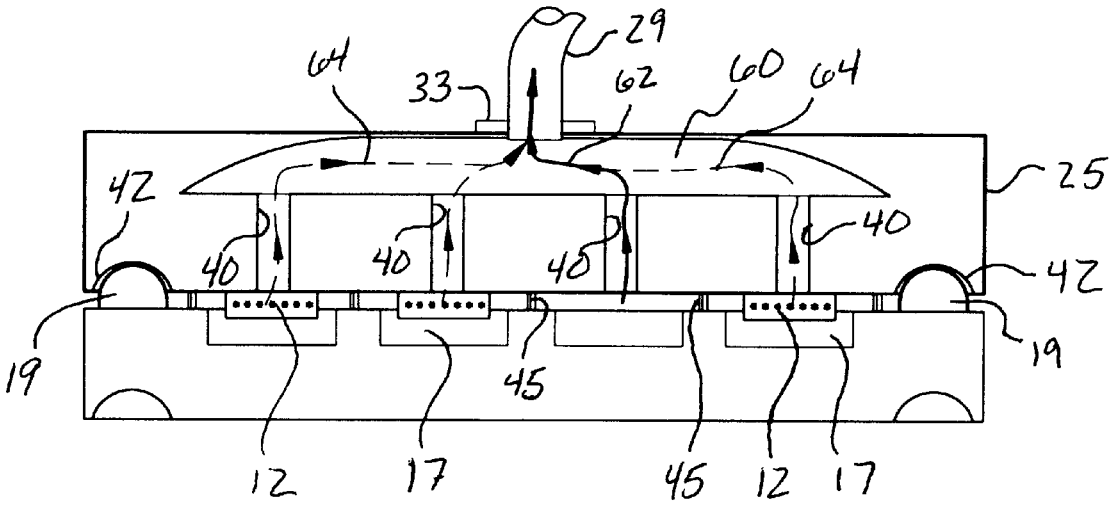
FIG. 5 is a cut-away view of the system in FIG. 1 in accordance with the third and fourth steps of FIG. 3.

Returning to FIG. 3, with the tray 15 and plate 25 aligned, the pneumatic motor 27 operates to provide "activate air flow through the holes 40 such that the parts 12 will move to alter the air flow" as set forth in block 56. As illustrated in FIG. 5, because the pneumatic motor 27 provides a suction of air flow through the holes 40, any parts 12 located in the adjacent tray locations 17 will move to cover at least a portion of the respective holes 40. For every part 12 that moves to cover at least a portion of a hole 40, the air flow back to the pneumatic motor 27 will change. Consequently, the sensor(s) panel 31 will recognize this change and "determine from the altered air flow the number of the parts" as set forth in block 58.

The altered air flow can be evaluated to determine the number of parts by a conventional computer processing unit (not shown) having a storage medium using a mathematical algorithm, or by a simple logic circuit which could be contained with the sensor(s) panel 31. Once evaluated, the user will be provided with a visual display such as a computer screen or LED display, or an audible alarm. Additionally, if desired, the sensed change in air flow and calculated number of parts can be stored on a storage medium for operational history or inventory procedure purposes. In some embodiments, the airflow can be deactivated once the parts 12 are counted to reposition the parts 12 in the tray 15.

Alternative Embodiments of the Invention

As mentioned above, a hose 29 couples the pneumatic plate 25 to a motor 27. The motor 27 should have enough power to create a suction capable of moving a part 12 from its respective tray location 17 to cover a least a portion of the respective hole 40 from which the suction is generated. Sensor(s) panel 31 allows the air flow to be regulated. By regulating the air flow through the hose 29, the pneumatic system can increase or decrease suction in the holes 40 as necessary during operation. Additionally, with reference to FIGS. 4 and 5, within a chamber 60, the single hose 29 feeds all the holes 40 of the plate 25. It should be appreciated by persons of ordinary skill in the relevant arts that the hose 29 could include numerous hoses (not shown). Each hose would couple to each respective hole 40 or a number of channels (not shown) within the chamber 60 to accommodate a desired air flow. With respect to the sensors for monitoring the airflow, the skilled artisan should recognize that numerous pressure sensors could be located in the pneumatic plate or at any location between the plate and the motor.

Remarks

Thus, the invention in its various embodiments addresses many problems found in the prior art. The particular embodiments disclosed above, however, are illustrative only, as the invention may be modified and practiced in different but equivalent manners apparent to those skilled in the art having the benefit of the teachings herein. Furthermore, no limitations are intended in regards to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A method for counting parts comprising:

a) positioning a tray having an array of part locations;

b) aligning a complementary array of holes in a plate with the part locations;

c) activating an air flow through the holes such that the parts will move to alter the air flow; and d) determining from the altered air flow the number of parts.

2. The method of claim 1, wherein determining from the altered flow the number of parts further includes sensing the change of air flow through the plate holes.

3. The method of claim 1, further comprising storing the number of parts on a storage media.

4. The method of claim 1, further comprising updating a storage media to inventory the parts relative to the sensed change of air flow.

5. The method of claim 1, wherein positioning the tray includes sensing when the tray reaches a predetermined position.

6. The method of claim 1, wherein aligning the complementary array of holes further includes sensing when the positioned plate and holes cover and align with the tray locations, respectively.

7. The method of claim 1, further comprising de-activating the air flow through the holes of the plate to position the parts back into the tray.

8. The process of claim 1, wherein the operations of positioning and aligning further include moving the tray of parts and plate of holes by an automated process.

9. A process of counting parts comprising:

a) positioning a tray having an array of locations for holding the parts;

b) sensing when the tray reaches a predetermined position;

c) aligning a plate having an array of holes over the tray, the array of holes being arranged ranged to complement and align with the array of locations for holding the parts;

d) activating an air flow through the holes of the plate;

e) determining from a change of air flow how many parts are located in the tray; and f) deactivating the air flow through the holes of the plate to re-position the parts into the locations of the tray.

10. The process of claim 9, wherein aligning further includes sensing when the plate covers the tray surface area such that the holes of the plate align with the locations of the plate.

11. The process of claim 9, wherein activating an air flow further includes updating a storage media to inventory the number of determined parts located in the tray.

12. The process of claim 9, wherein determining how many parts located in the tray further includes altering the position of the parts in the tray location by the air flow.

* * * * *

UNITED STATES PATENT AND TRADEMARK OFFICE

CERTIFICATE OF CORRECTION

PATENT NO. : 5,940,465

DATED : 08/17/99

INVENTOR(S) : Steven J. Brunelle

It is certified that error appears in the above-identified patent and that said Letters Patent is hereby corrected as shown below:

In col. 6, line 20, after "parts" insert --are--.

Signed and Sealed this
First Day of February, 2000

*Attest:*

Q. TODD DICKINSON

*Attesting Officer*

*Acting Commissioner of Patents and Trademarks*